US009011120B2

(12) United States Patent
Adachi et al.

(10) Patent No.: US 9,011,120 B2
(45) Date of Patent: Apr. 21, 2015

(54) SCROLL COMPRESSOR WITH BEARING GROOVES ON BOTH SIDES OF KEY GROOVE

(71) Applicant: Panasonic Corporation, Kadoma-shi, Osaka (JP)

(72) Inventors: Tooru Adachi, Shiga (JP); Nobuaki Ogawa, Shiga (JP); Minoru Fukumoto, Nara (JP); Kiyozumi Kusano, Shiga (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 89 days.

(21) Appl. No.: 13/721,889

(22) Filed: Dec. 20, 2012

(65) Prior Publication Data

US 2013/0164164 A1 Jun. 27, 2013

(30) Foreign Application Priority Data

Dec. 21, 2011 (JP) ..... 2011-279419

(51) Int. Cl.
*F04C 18/02* (2006.01)
*F01C 17/06* (2006.01)

(52) U.S. Cl.
CPC ..... *F04C 18/0215* (2013.01); *F01C 17/066* (2013.01)

(58) Field of Classification Search
CPC ..... F01C 17/066
USPC ..... 418/55.2, 55.3, 55.5; 464/102, 104
See application file for complete search history.

(56) References Cited

U.S. PATENT DOCUMENTS

| | | | | | |
|---|---|---|---|---|---|
| 4,702,683 | A | * | 10/1987 | Inaba et al. | 418/55.6 |
| 4,795,322 | A | * | 1/1989 | Etemad et al. | 418/55.6 |
| 4,958,993 | A | | 9/1990 | Fujio | |
| 5,947,709 | A | * | 9/1999 | Koyama et al. | 418/55.6 |
| 6,106,252 | A | * | 8/2000 | Yamanaka et al. | 418/55.3 |
| 2008/0050260 | A1 | * | 2/2008 | Iwanami et al. | 418/55.6 |

FOREIGN PATENT DOCUMENTS

| | | | | |
|---|---|---|---|---|
| CN | 1482363 | | | 3/2004 |
| JP | 7-042943 | | | 5/1995 |
| JP | 08219043 | A | * | 8/1996 |
| JP | 2004100660 | A | * | 4/2004 |
| JP | 2010048185 | A | * | 3/2010 |

* cited by examiner

*Primary Examiner* — Thomas Denion
*Assistant Examiner* — Xiaoting Hu
(74) *Attorney, Agent, or Firm* — Hamre, Schumann, Mueller & Larson, P.C.

(57) ABSTRACT

In a scroll compressor of the present invention, a fixed scroll 11 and an orbiting scroll 12 are meshed with each other such that spiral laps of the fixed scroll 11 and the orbiting scroll 12 inwardly face each other, an Oldham ring 26 is provided between the main bearing member 19 and the orbiting scroll 12, and a key portion of the Oldham ring 26 is inserted into a key groove 19*a* of the main bearing member 19. Grooves 19*b* are formed in Oldham ring 26 sliding surfaces on both sides of the key groove 19*a*. According to this configuration, the Oldham ring 26 and the main bearing member 19 can be restrained from coming into contact with each other in the vicinity of the bearing key groove 19*a*, and restrained from vibrating, and it is possible to provide an inexpensive scroll compressor of low noise.

4 Claims, 15 Drawing Sheets

12 orbiting scroll
19 main bearing member
19a key groove of main bearing member
19b groove in the vicinity of the of key groove
26 Oldham ring 12 orbiting scroll
19 main bearing member
19a key groove of main bearing member
19b groove in the vicinity of the of key groove
26 Oldham ring (a)

(b)

(a)

(b)

(a)

(b)

(a)

(b)

(a)

(b)

(a)

(b)

Fig. 14 -- Prior Art --
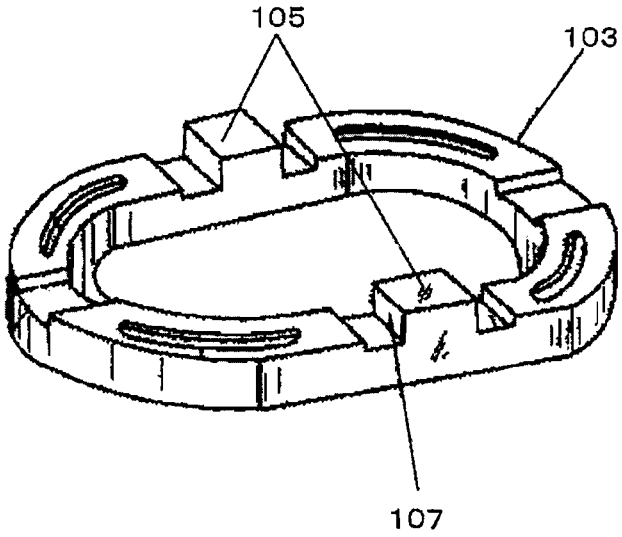

Fig. 15 -- Prior Art --
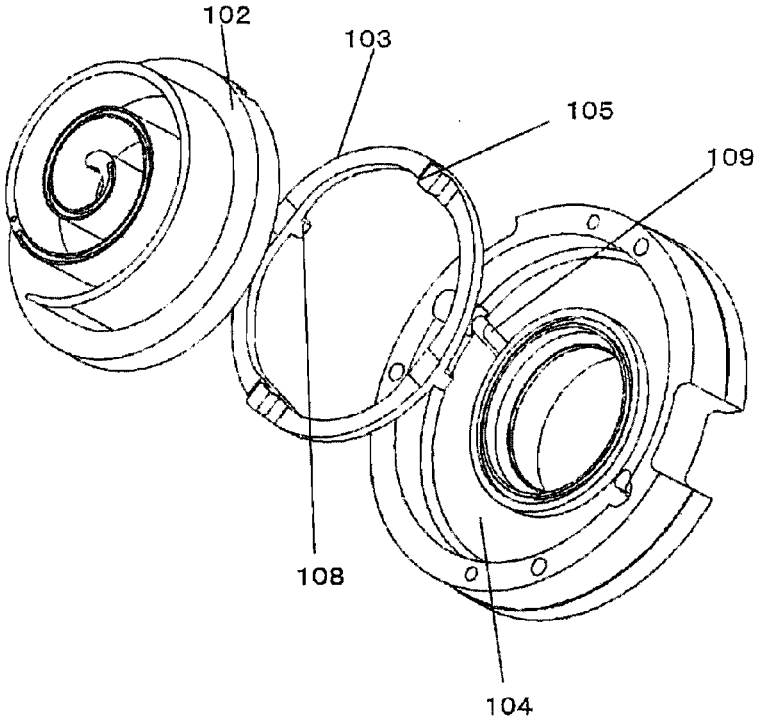

SCROLL COMPRESSOR WITH BEARING GROOVES ON BOTH SIDES OF KEY GROOVE

TECHNICAL FIELD

The present invention relates to a scroll compressor applied to an air conditioner or a refrigeration device.

BACKGROUND TECHNIQUE

A scroll compressor is utilized as a compressor of a domestic room air conditioner, a refrigerator, or a compressor for an automobile air conditioner. In the scroll compressor, an Oldham ring is used as a scroll-rotation preventing mechanism for swinging an orbiting scroll (see patent document 1 for example).

As shown in FIG. 14, this Oldham ring 103 includes a pair of parallel keys 105. The parallel keys 105 are slidably fitted into key grooves provided in the orbiting scroll, thereby swinging the orbiting scroll while preventing the orbiting scroll from rotating. Recesses 107 are provided in roots of each of the parallel keys 105 of the Oldham ring 103, lubricating oil is supplied to the parallel keys 105 through the recesses 107 so that the orbiting scroll can smoothly swing.

Further, as shown in FIG. 15, in recent scroll compressors, a pair of parallel keys 108 are provided also on side surfaces of a main bearing member 104 of the Oldham ring 103, and key grooves 109 are formed in the main bearing member 104. By fitting the parallel keys 108 into the key grooves 109, a member such as a thrust bearing member shown in patent document 1 is removed, thereby reducing costs.

PRIOR ART DOCUMENT

Patent Document

[Patent Document 1] Japanese Patent Publication No. H7-42943

SUMMARY OF THE INVENTION

Problem to be Solved by the Invention

According to the conventional scroll compressor, however, an orbiting scroll 102 is pushed toward the main bearing member 104 at the time of a compressing operation by variation in compressing pressure in a compression chamber formed between the orbiting scroll 102 and a fixed scroll. The scroll compressor receives a movement of the orbiting scroll 102 toward the main bearing member 104, i.e., a reaction force of the orbiting scroll 102. As a result, the conventional scroll compressor has a problem that a portion of the Oldham ring 103 close to the parallel key 108 and a portion of the main bearing member 104 close to the key groove 109 vibrate and come into contact with each other in the vicinity of the key groove 109 of the main bearing member 104, and an operation sound is generated.

The present invention has been accomplished to solve the conventional problem, and it is an object of the invention to provide an inexpensive scroll compressor of low noise which suppresses the operation sound generated by contact caused by vibration of the key groove and the Oldham ring.

Means for Solving the Problems

To solve the conventional problem, the present invention provides a scroll compressor in which an orbiting scroll is provided between a main bearing member and a fixed scroll, the fixed scroll and the orbiting scroll are meshed with each other such that spiral laps of the fixed scroll and the orbiting scroll inwardly face each other, an Oldham ring is provided between the main bearing member and the orbiting scroll, and a key portion of the Oldham ring is inserted into a key groove of the main bearing member, wherein grooves are formed in Oldham ring sliding surfaces on both sides of the key groove. By the grooves, it is possible to suppress the operation sound generated by contact caused by vibration of the key groove and the Oldham ring.

Effect of the Invention

According to the scroll compressor of the invention, it is possible to suppress a case where the Oldham ring and the key groove of the main bearing member come into contact with each other and the vibrate, or a case where a portion of the Oldham ring in an intersecting direction and the key groove of the main bearing member come into contact with each other and the vibrate, and operation sound can be suppressed, and it is possible to provide an inexpensive scroll compressor of low noise.

BRIEF DESCRIPTION OF THE DRAWINGS

FIG. 14 is a perspective view of an Oldham ring according to a conventional scroll compressor; and FIG. 15 is an exploded perspective view of a main bearing member showing another conventional scroll compressor.

EXPLANATION OF SYMBOLS

Figure 1:
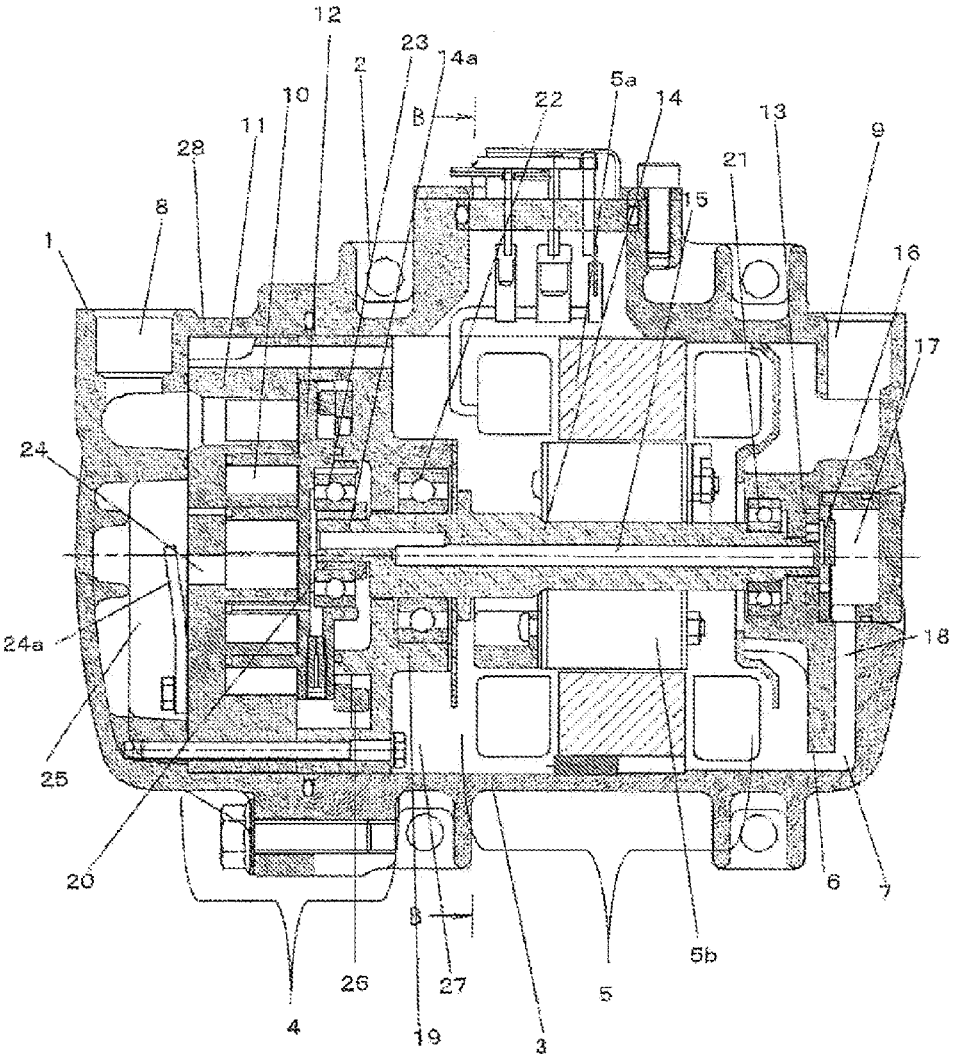
FIG. 1 is a transverse sectional view of a scroll compressor according to a first embodiment of the present invention.

1 scroll compressor
2 mounting leg
3 body casing
4 compressing mechanism
5 motor
5*a* stator
5*b* rotor
6 liquid reservoir
7 lubricating oil
8 suction port
9 discharge port
10 compression space
11 fixed scroll
12 orbiting scroll
13 pump
14 drive shaft
14*a* eccentric shaft
15 drive shaft supply path
16 lid
17 pump chamber
18 pumping passage
19 main bearing member
19*a* key groove
19*b*, 19*c*, 19*d*, 19*e*, 19*f*, 19*h* groove
19*i* groove
19*x* Oldham ring sliding surface
20 bush
21 auxiliary ball bearing
22 main ball bearing
23 eccentric ball bearing
24 discharge port
24*a* reed valve
25 discharge chamber
26 Oldham ring
26*a* first key portion
26*b* second key portion
26*c* relief groove
26*d* back side
27 communication passage
28 sub-casing

MODE FOR CARRYING OUT THE INVENTION

A first aspect of the present invention provides a scroll compressor in which an orbiting scroll is provided between a main bearing member and a fixed scroll, the fixed scroll and the orbiting scroll are meshed with each other such that spiral laps of the fixed scroll and the orbiting scroll inwardly face each other, an Oldham ring is provided between the main bearing member and the orbiting scroll, and a key portion of the Oldham ring is inserted into a key groove of the main bearing member, wherein grooves are formed in Oldham ring sliding surfaces on both sides of the key groove. According to this configuration, even if a reaction force from the orbiting scroll is received and the Oldham ring vibrates at a portion of the main bearing member in the vicinity of the key groove, since a gap is secured between the Oldham ring and the main bearing member, the Oldham ring and the main bearing member do not come into contact with each other. Therefore, a contact sound caused by contact is not generated, and it is possible to provide the scroll compressor of low noise.

According to a second aspect of the invention, in the scroll compressor of the first aspect, a portion of each of the grooves in a sliding direction of the Oldham ring has a slope shape.

According to a third aspect of the invention, in the scroll compressor of the first or second aspect, relief grooves are formed in both sides of the key portion, and the grooves are separated from the key groove.

According to a fourth aspect of the invention, in the scroll compressor of the first aspect, the grooves are laterally symmetrically formed in ranges of 60% or less of a diameter of the Oldham ring with respect to the key groove.

According to a fifth aspect of the invention, in the scroll compressor of the first aspect, the grooves are laterally symmetrically formed in ranges of 45° or less on left and right sides with respect to the key groove.

Embodiments of the present invention will be described with reference to the drawings. The invention is not limited to the embodiments.

First Embodiment

Figure 2:
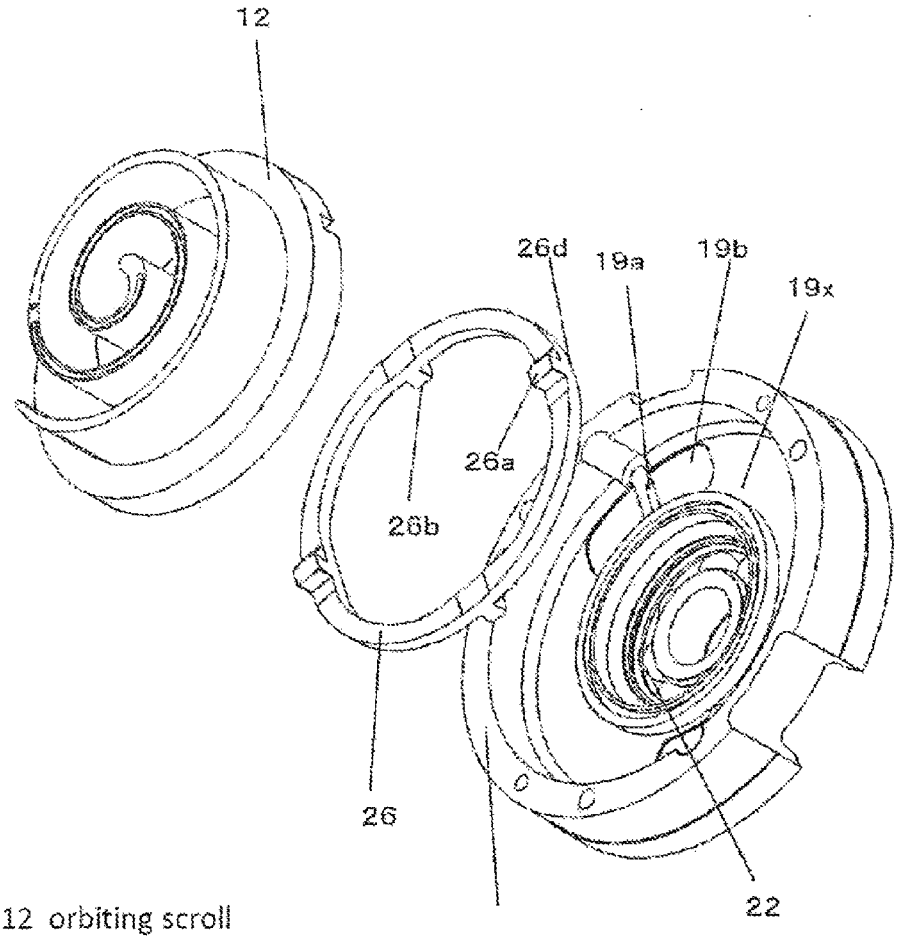
FIG. 2 is an exploded perspective view of a main bearing member of the scroll compressor of the first embodiment.
Figure 3:
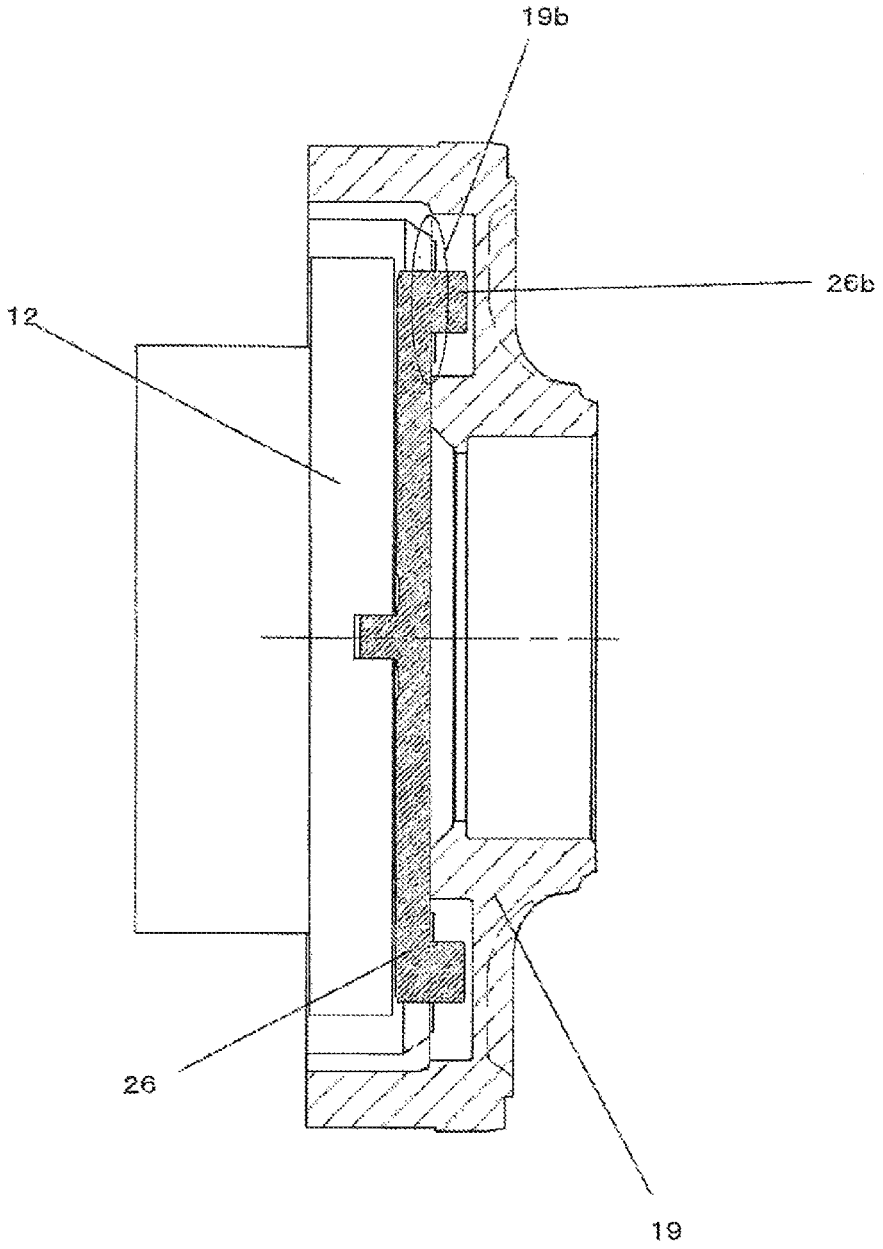
FIG. 3 is a transverse sectional view of the main bearing member of the scroll compressor of the first embodiment.
Figure 4:
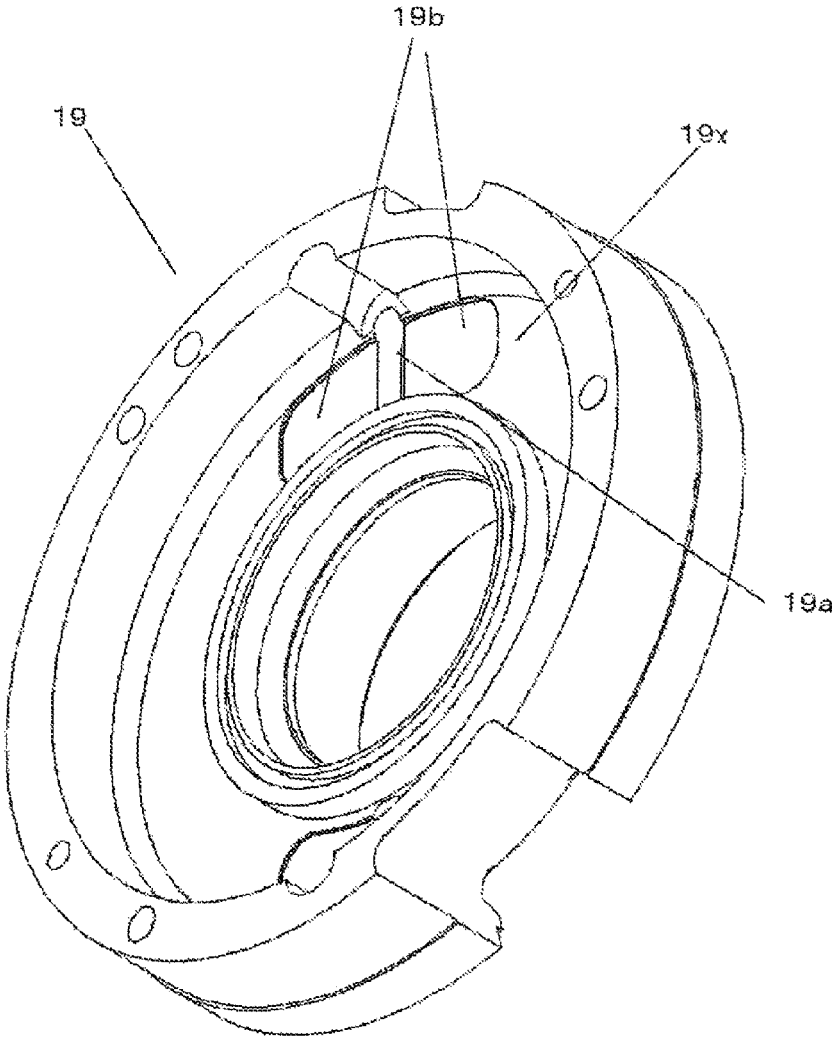
FIG. 4 is a perspective view of the main bearing member of the scroll compressor of the first embodiment.
Figure 5:
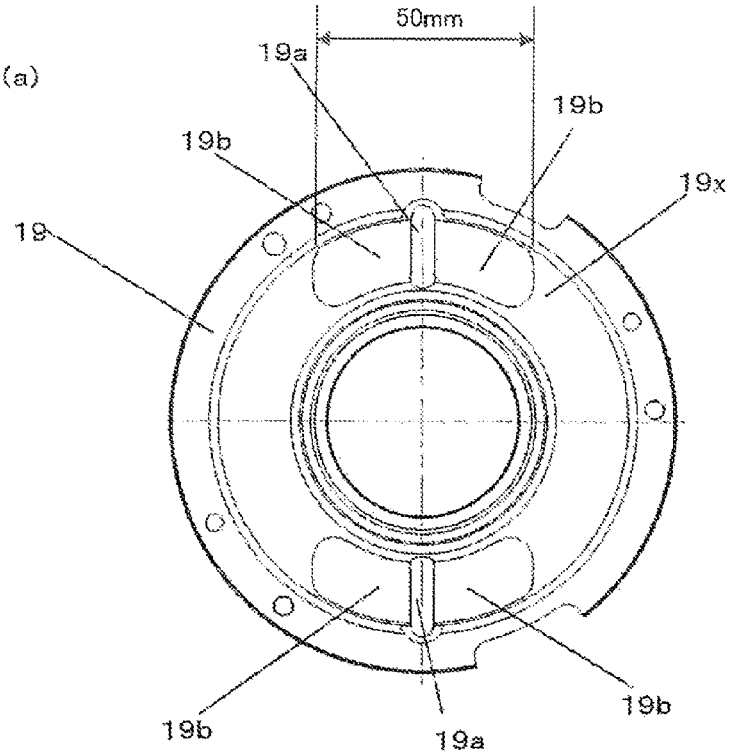
FIG. 5(*a*) is a front view of the main bearing member of the scroll compressor of the first embodiment, and FIG. 5(*b*) is a front view when an Oldham ring is superposed on the main bearing member of the scroll compressor of the first embodiment.
Figure 5:
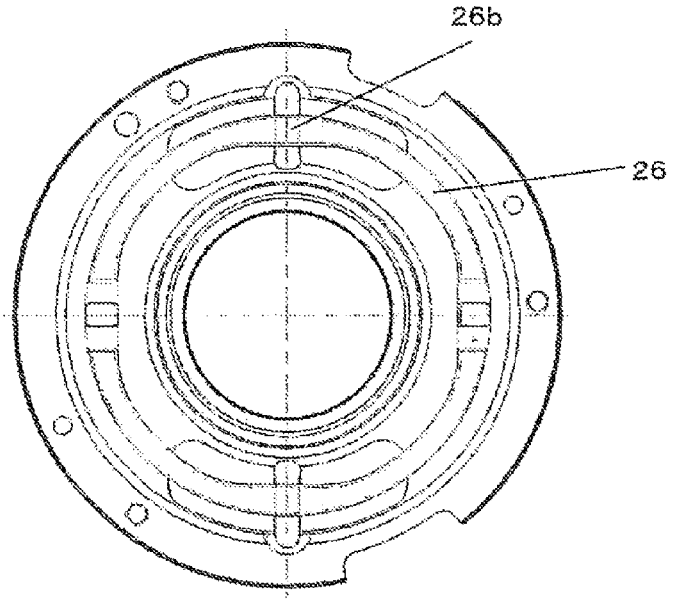

FIG. 1 is a transverse sectional view of a scroll compressor according to a first embodiment of the present invention. FIG. 2 is an exploded perspective view of a main bearing member of the scroll compressor. FIG. 3 is a transverse sectional view of the main bearing member of the scroll compressor. FIG. 4 is a perspective view of the main bearing member of the scroll compressor. FIG. 5(*a*) is a front view of the main bearing member of the scroll compressor, and FIG. 5(*b*) is a front view when an Oldham ring is superposed on the main bearing member of the scroll compressor.

The scroll compressor 1 of the first embodiment is one example of a horizontal scroll compressor which is horizontally installed by means of mounting legs 2 provided around a barrel of the scroll compressor 1.

The scroll compressor 1 includes a body casing 3. A compressing mechanism 4 and a motor 5 which drives the compressing mechanism 4 are incorporated in the body casing 3. The body casing 3 is provided therein with a liquid reservoir 6 in which liquid for lubricating various sliding portions including the compressing mechanism 4 is stored. The motor 5 is driven by a motor driving circuit (not shown).

The scroll compressor 1 compresses a gas refrigerant. Lubricating oil 7 is used for lubricating sliding portions in the body casing 3 and for sealing sliding portions of the compressing mechanism 4. The lubricant oil 7 has compatibility with the refrigerant which is used in the scroll compressor.

The pump 13, an auxiliary ball bearing 21, the motor 5 and a main bearing member 19 including a main ball bearing 22 are disposed in the body casing 3 in this order from one of end walls of the body casing 3 in its axial direction.

The pump 13 is accommodated from an outer surface of the end wall and then, the pump 13 is fitted therein by a lid 16. A pump chamber 17 which is in communication with the liquid reservoir 6 is formed inside of the lid 16. The pump chamber 17 is in communication with the liquid reservoir 6 through a pumping passage 18. The auxiliary ball bearing 21 is supported by the end wall. A side of the drive shaft 14 which is connected to the pump 13 is turnably held by the auxiliary ball bearing 21. The motor 5 includes a stator 5*a* and a rotor 5*b*. The stator 5*a* is fixed to an inner periphery of the body casing 3. The rotor 5*b* is fixed to an intermediate position of the drive shaft 14, and rotates the drive shaft 14.

The main bearing member 19 is fixed to an inner periphery of a sub-casing 28 through a bolt or the like. A side of the drive shaft 14 which is close to the compressing mechanism 4 is turnably held by the main ball bearing 22. A fixed scroll 11 is mounted on an outer peripheral surface of the main bearing member 19 through a bolt or the like. An orbiting scroll 12 is sandwiched between the main bearing member 19 and the fixed scroll 11. The fixed scroll 11 and the orbiting scroll 12 are meshed with each other such that spiral laps thereof inwardly face each other. A compression space 10 is formed between the lap of the fixed scroll 11 and the lap of the orbiting scroll 12.

An Oldham ring 26 is provided between the main bearing member 19 and the orbiting scroll 12. The Oldham ring 26 prevents the orbiting scroll 12 from rotating and swings the orbiting scroll 12.

An eccentric shaft 14*a* is integrally formed on an end of the drive shaft 14 on the side of the orbiting scroll 12. A bush 20 is fitted over an outer periphery of the eccentric shaft 14*a*. An eccentric ball bearing 23 is provided on an outer periphery of the bush 20. The eccentric ball bearing 23 is accommodated in a back surface of the orbiting scroll 12. A portion of the compressing mechanism 4 which is exposed from the sub-casing 28 toward the motor is covered with the body casing 3. The sub-casing 28 and the body casing 3 are fixed to each other through a bolt such that opening of both the members are butted against each other.

The compressing mechanism 4 is located between a suction port 8 of the sub-casing 28 and a discharge port 9 of the body casing 3. A suction port of the compressing mechanism 4 is connected to the suction port 8 of the sub-casing 28, and a discharge port 24 of the compressing mechanism 4 is connected to a discharge chamber 25 through a reed valve 24*a*. The discharge chamber 25 is in communication with a space around the motor 5 through a communication passage 27 formed in the fixed scroll 11 and the main bearing member 19, and is further in communication with the discharge port 9. The communication passage 27 may be formed between the fixed scroll 11 and the body casing 3 and between the main bearing member 19 and the body casing 3.

The Oldham ring 26 is provided between the main bearing member 19 and the orbiting scroll 12 and prevents the orbiting scroll 12 from rotating. As shown in FIG. 2, the Oldham ring 26 is provided at its end surfaces with a pair of first key portions 26*a* and a pair of second key portions 26*b*.

The pair of first key portions 26*a* are provided on one of the end surfaces of the Oldham ring 26, and the pair of second key portions 26*b* are provided on the other end surface of the Oldham ring 26. A phantom line connecting the pair of first key portions 26*a* to each other intersects with a phantom line connecting the pair of second key portions 26*b* to each other. The first key portions 26*a* are slidably fitted in key grooves of the orbiting scroll 12, and the second key portions 26*b* are slidably fitted into key grooves 19*a* provided in the main bearing member 19.

Here, the Oldham ring 26 is formed by a sintering producing method for example. Therefore, due to a reason of the producing method, there is a tendency that flatness of each of left and right sides of the key portions 26*a* and 26*b* is poor and flatness of back side 26*d* of the key portion 26*a* on the side of the orbiting scroll 12 is excellent. Therefore, when the Oldham ring 26 slides on the main bearing member 19, at a portion of the main bearing member 19 in the vicinity of a key groove 19*a*, portions of the Oldham ring 26 in the vicinity of left and right sides of the second key portions 26*b* easily come into contact with Oldham ring sliding surfaces 19*x* of the main bearing member 19.

Hence, grooves 19*b* are laterally symmetrically formed in the Oldham ring sliding surfaces 19*x* on both sides of each of the key grooves 19*a* of the main bearing member 19 with respect to the key grooves 19*a*. Each of the grooves 19*b* has a width of about 50 mm and a depth of 0.4 mm. By the grooves 19*b*, gaps are formed between the second key portions 26*b* and the key grooves 19*a*, and abutment, against the main bearing member 19, of the portions of the Oldham ring 26 in the vicinity of left and right sides of the second key portion 26*b* caused by poor flatness thereof is absorbed.

Operations and effects of the scroll compressor 1 having the above-described configuration will be described.

First, the motor 5 is driven by the motor driving circuit, swings the orbiting scroll 12 of the compressing mechanism 4 through the drive shaft 14, and drives the pump 13. The compression space 10 is formed by meshing the spiral laps of the fixed scroll 11 and the orbiting scroll 12 with each other. When the motor 5 swings the orbiting scroll 12 with respect to the fixed scroll 11 through the drive shaft 14, a capacity of the compression space 10 is varied with movement. By the variation in the capacity of the compression space 10, a refrigerant which returns from an external cycle is sucked, compressed and discharged to the external cycle. The refrigerant is sucked from the suction port 8 provided in the sub-casing 28, and is discharged from the discharge port 9 provided in the body casing 3.

Here, as shown in FIGS. 1 to 5, according to the scroll compressor, the grooves 19*b* are laterally symmetrically formed in the Oldham ring sliding surfaces 19*x* in the vicinity of the key grooves 19*a* of the main bearing member 19 with respect to the key grooves 19*a*. Each of the grooves 19*b* has the width of about 50 mm and the depth of 0.4 mm. Therefore, even if a reaction force from the orbiting scroll 12 is received and the Oldham ring 26 vibrates, since the gaps are secured between the portions of the Oldham ring 26 in the vicinity of the second key portions 26*b* and the left and right grooves 19*b* of the key grooves 19*a* of the main bearing member 19 each having poor flatness, the Oldham ring 26 does not come into contact with the main bearing +member 19 and a contact sound is not generated.

It is only necessary that the depth of each of the grooves 19*b* of the main bearing member 19 is set such that vibration of the Oldham ring 26 can be absorbed. As a result of an experiment, it could be confirmed that if the depth was about 0.2 mm to 0.5 mm, it was possible to restrain vibration sound from generating. As a result of an experiment, it is only necessary that the width of the groove 19*b* is within about 60% of a diameter of the Oldham ring 26, preferably within 45% of the diameter of the Oldham ring 26. If the width of the groove 19*b* exceeds 60%, an area of the Oldham ring sliding surface 19*x* of the main bearing member 19, i.e., an area of a portion other than the groove 19*b* becomes small. When the Oldham ring 26 receives the reaction force from the orbiting scroll 12, swinging vibration takes place from portions of the Oldham ring sliding surfaces 19*x* other than the grooves 19*b* as fulcrum points. That is, even if the grooves 19*b* are provided, portions of the Oldham ring 26 in the vicinity of the second key portions 26*b* come into contact with bottoms of the grooves 19*b* and there is fear that contact sound is generated and therefore, this is not preferable. If the width of the groove 19*b* is set within 60%, a sufficient area of the Oldham ring sliding surface 19*x* is secured, it is possible to restrain the Oldham ring 26 from swinging from these portions as the fulcrum points, and to reliably prevent the contact sound.

As described above, in this embodiment, the grooves 19*b* are laterally symmetrically formed in the Oldham ring sliding surfaces in the vicinity of the key grooves 19*a* of the main bearing member 19 with respect to the key grooves 19*a*, and each of the grooves 19*b* has the width of about 50 mm and the depth of 0.4 mm. Therefore, the Oldham ring 26 does not come into contact with the main bearing member 19 and contact sound is not generated. Therefore, since a noise of the compressor can be reduced, the compressor can especially suitably be applied as a compressor for an automobile air conditioner.

Second Embodiment

Figure 6:
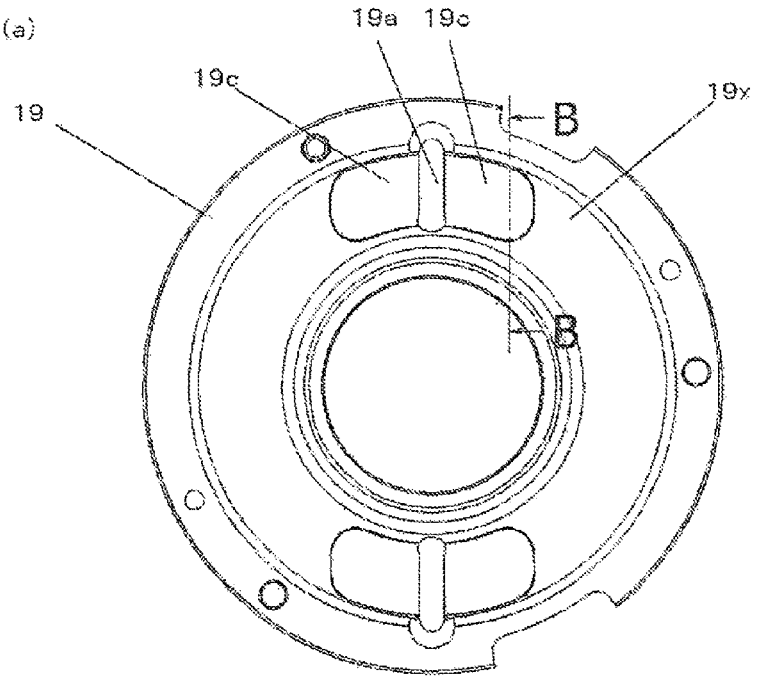
FIG. 6(*a*) is a front view of a main bearing member of a scroll compressor according to a second embodiment, and FIG. 6(*b*) is a sectional view taken along a B-B line in FIG. 6(*a*)
Figure 6:
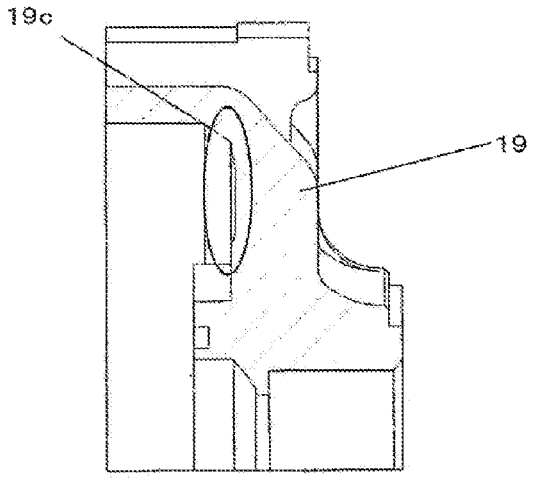

FIGS. 6(*a*) and 6(*b*) show a main bearing member of a scroll compressor according to a second embodiment of the present invention.

In these drawings, grooves 19*c* are laterally symmetrically formed in Oldham ring sliding surfaces 19*x* on both sides of each of key grooves 19*a* of a main bearing member 19 with respect to key grooves 19*a*. Each of the grooves 19*c* has a width of about 50 mm and a depth of 0.4 mm. A portion of each of the grooves 19*c* in a sliding direction of an Oldham ring 26 (outer peripheral end surface and inner peripheral end surface of groove 19*c*) is of a slope shape (portion surrounded by ring in FIG. 6 (*b*)). Hence, even if a reaction force from the orbiting scroll 12 is received and the Oldham ring 26 vibrates in the vicinity of the of the key groove 19*a* of the main bearing member 19, the Oldham ring 26 does not come into contact with the main bearing member 19 and contact sound is not generated of course as in the first embodiment. Further, in the second embodiment, also when the Oldham ring 26 slides on the groove 19*c*, an edge thereof does not easily abut and wearing is small.

As described above, in this embodiment, it is possible to reduce a noise of the compressor, wearing between the Oldham ring 26 and the main bearing member 19 can also be reduced, and it is possible to provide a reliable scroll compressor.

Third Embodiment

Figure 7:
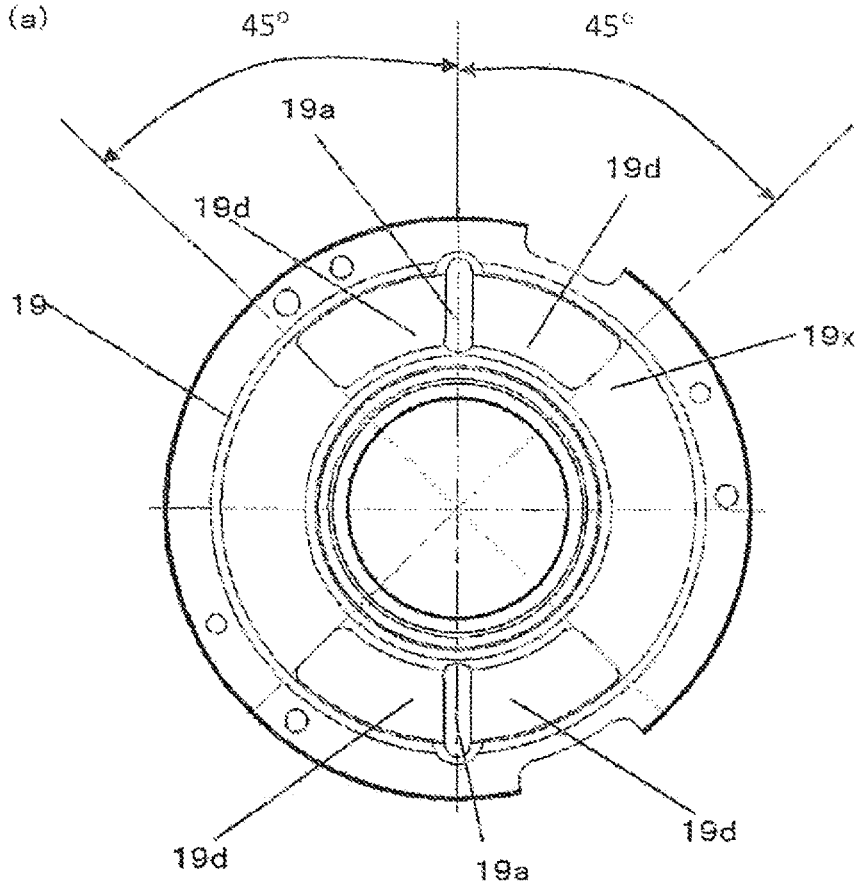
FIG. 7(*a*) is a front view of a main bearing member of a scroll compressor according to a third embodiment, and FIG. 7(*b*) is a front view when an Oldham ring is superposed on the main bearing member of the scroll compressor of the third embodiment.
Figure 7:
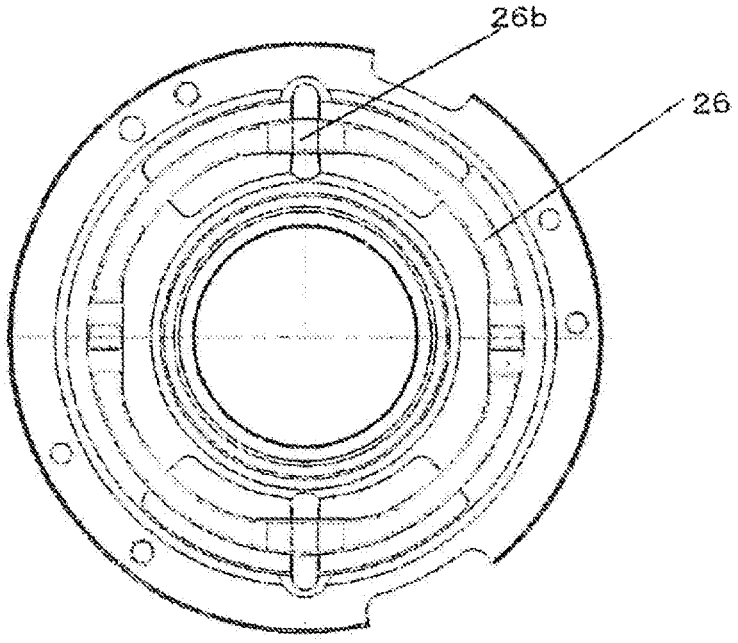

FIG. 7 (*a*) is a front view of a main bearing member of a scroll compressor according to a third embodiment of the present invention, and FIG. 7 (*b*) is a front view when an Oldham ring is superposed on the main bearing member. In these drawings, grooves 19*d* are formed on left and right sides of Oldham ring sliding surfaces 19*x* in the vicinity of the key grooves 19*a* of the main bearing member 19 with respect to key grooves 19*a* in ranges of 45°. Each of the grooves 19*d* has a depth of 0.5 mm.

In this embodiment, since the grooves 19*d* in the vicinity of the key grooves 19*a* of the main bearing member 19 are formed in the ranges of 45°, a sufficient area of each of the Oldham ring sliding surfaces 19*x* as described in the first embodiment is secured, and swinging of the Oldham ring 26 from these portions as fulcrum points can be suppressed. Hence, even if a reaction force from the orbiting scroll 12 is received and the Oldham ring 26 vibrates in the vicinity of the key groove 19*a* of the main bearing member 19, a gap between a portion of the Oldham ring 26 in the vicinity of the second key portion 26*b* and the left and right grooves 19*d* of the key grooves 19*a* of the main bearing member 19 functions, the Oldham ring 26 does not come into contact with the main bearing member 19, and contact sound is not generated.

If the grooves 19*d* are formed within 45° from the left and right sides with respect to the key grooves 19*a*, sufficient areas of the Oldham ring sliding surfaces 19*x* are secured, the swinging of the Oldham ring 26 from these portions as the fulcrum points can be suppressed, and it is possible to reliably prevent contact sound. If the grooves 19*d* exceed the ranges of 45°, the areas of the Oldham ring sliding surfaces 19*x* of the main bearing member 19, i.e., areas other than the grooves 19*d* become small. Hence, when the Oldham ring 26 receives a reaction force from the orbiting scroll 12, swinging takes place from the portions of the Oldham ring sliding surfaces 19*x* other than the grooves 19*d* as fulcrum points. That is, even if the grooves 19*d* are provided, portions of the Oldham ring 26 in the vicinity of the second key portions 26*b* come into contact with bottoms of the grooves 19*d* and there is fear that contact sound is generated and therefore, this is not preferable.

As described above, in the third embodiment, the grooves 19*d* are laterally symmetrically formed within the 45° ranges in the Oldham ring sliding surfaces in the vicinity of the of the key grooves 19*a* of the main bearing member 19 with respect to the key grooves 19*a*, and each of the grooves 19*d* has the depth of 0.5 mm. Therefore, the Oldham ring 26 does not come into contact with the main bearing member 19 and contact sound is not generated. Therefore, since a noise of the compressor can be reduced, the compressor can especially suitably be applied as a compressor for an automobile air conditioner.

Fourth Embodiment

Figure 8:
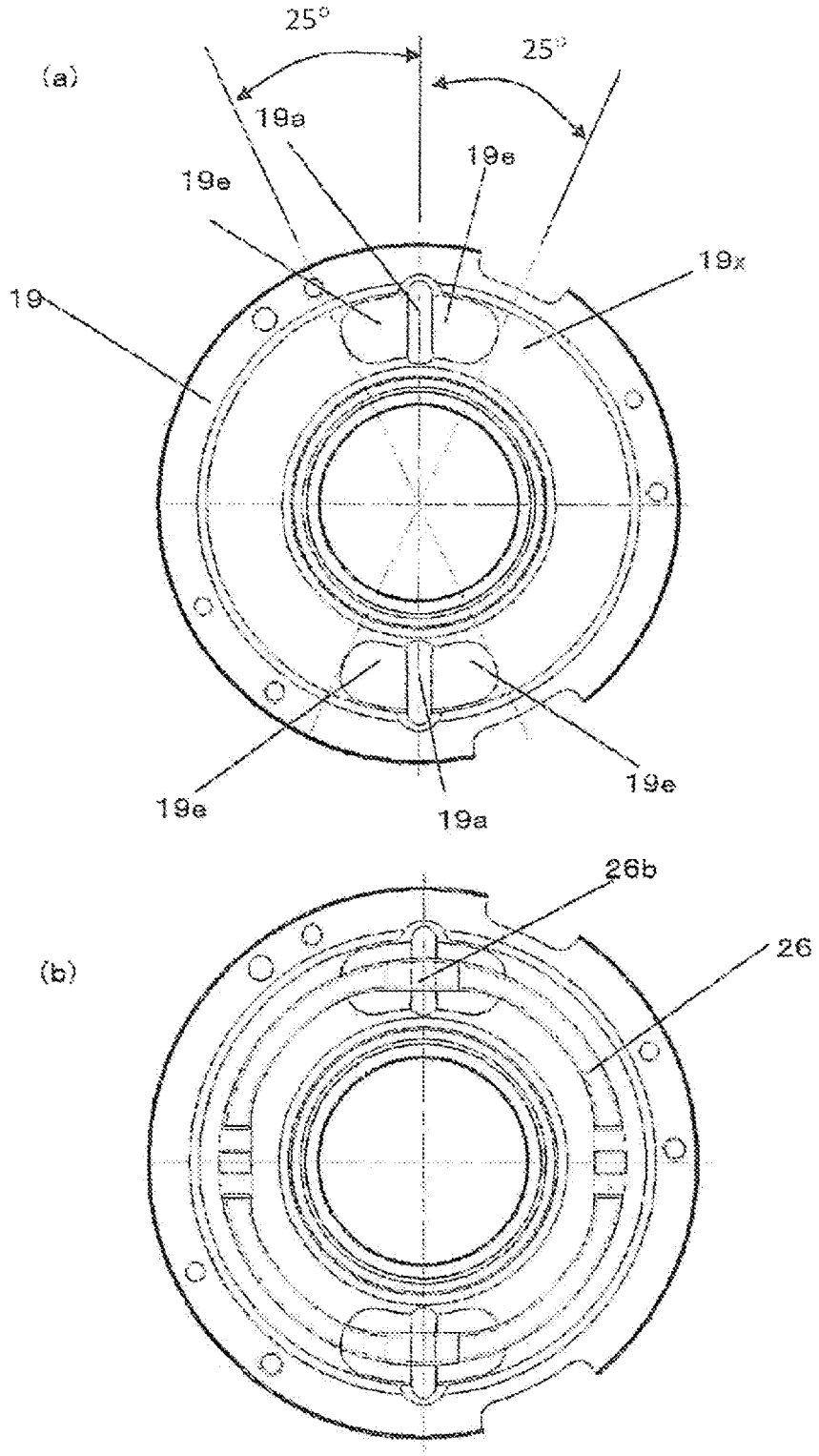
FIG. 8(*a*) is a front view of a main bearing member of a scroll compressor according to a fourth embodiment, and FIG. 8(*b*) is a front view when an Oldham ring is superposed on the main bearing member of the scroll compressor of the fourth embodiment.

FIG. 8(*a*) is a front view of a main bearing member of a scroll compressor according to a fourth embodiment of the present invention, and FIG. 8(*b*) is a front view when an Oldham ring is superposed on the main bearing member. In these drawings, grooves 19*e* are laterally symmetrically formed in Oldham ring sliding surfaces 19*x* on both sides of key grooves 19*a* of a main bearing member 19 with respect to the key grooves 19*a* in ranges of 25°, and each of the grooves 19*e* has a depth of 0.2 mm. Corner portions of both sides of the groove 19*e* have large R-shapes.

In the fourth embodiment, since the grooves 19*e* in the vicinity of the key grooves 19*a* of the main bearing member 19 are formed in the 25° ranges, areas of the Oldham ring sliding surfaces 19*x* as described in the first embodiment can be secured more sufficiently, and swinging of the Oldham ring 26 from these portions as fulcrum points can be suppressed. Hence, even if a reaction force from the orbiting scroll 12 is received and the Oldham ring 26 vibrates in the vicinity of the key groove 19*a* of the main bearing member 19, a gap between a portion of the Oldham ring 26 in the vicinity of the second key portion 26*b* and the left and right grooves 19*e* of the key grooves 19*a* of the main bearing member 19 functions, the Oldham ring 26 does not come into contact with the main bearing member 19, and contact sound is not generated.

As described above, in this embodiment, the grooves 19*e* are laterally symmetrically formed within the 25° ranges in the Oldham ring sliding surfaces 19*x* in the vicinity of the of the key grooves 19*a* of the main bearing member 19 with respect to the key grooves 19*a*, and each of the grooves 19*e* has the depth of 0.2 mm. Therefore, the Oldham ring 26 does not come into contact with the main bearing member 19 and contact sound is not generated. Therefore, since a noise of the compressor can be reduced, the compressor can especially suitably be applied as a compressor for an automobile air conditioner.

Fifth Embodiment

Figure 9:
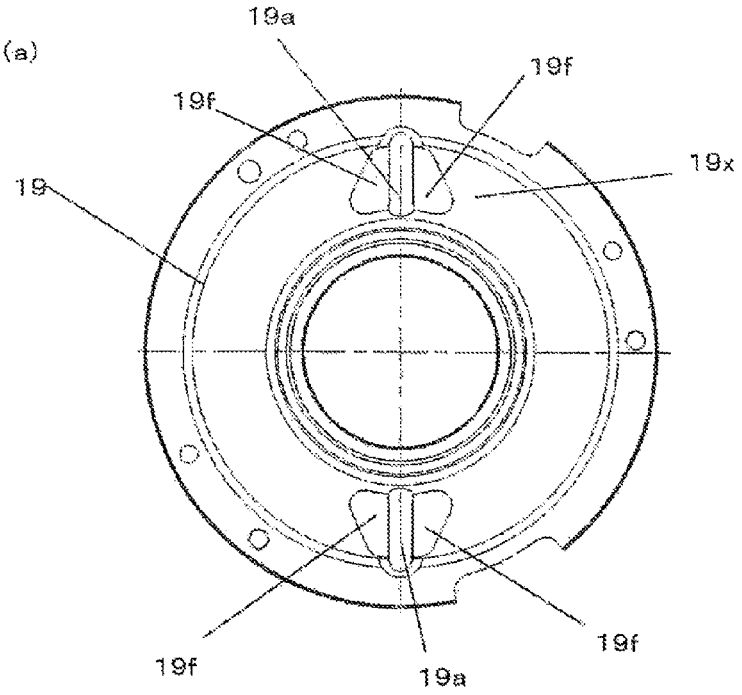
FIG. 9(*a*) is a front view of a main bearing member of a scroll compressor according to a fifth embodiment, and FIG. 9(*b*) is a front view when an Oldham ring is superposed on the main bearing member of the scroll compressor of the fifth embodiment.
Figure 9:
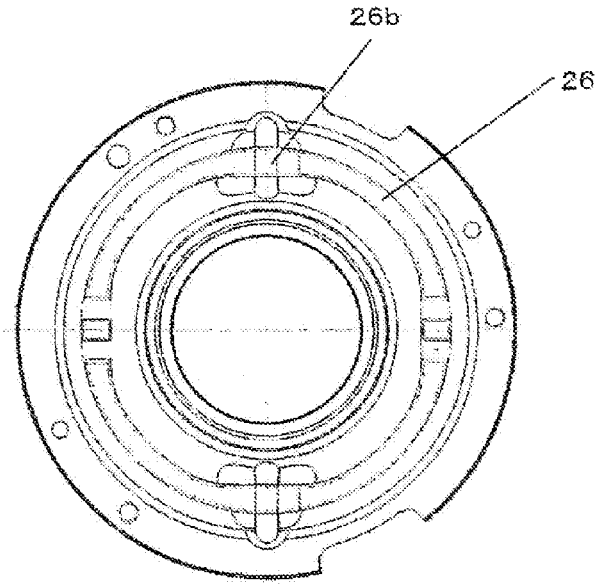

FIG. 9(*a*) is a front view of a main bearing member of a scroll compressor according to a fifth embodiment of the present invention, and FIG. 9 (*b*) is a front view when an Oldham ring is superposed on the main bearing member. In these drawings, grooves 19*f* are laterally symmetrically formed in Oldham ring sliding surfaces 19*x* on both sides of key grooves 19*a* of a main bearing member 19 with respect to the key grooves 19*a*, and each of the grooves 19*f* has a depth of 0.3 mm. A length of an inner peripheral end surface of the groove 19*f* is longer than a length of its outer peripheral end surface.

In this embodiment also, even if a reaction force from the orbiting scroll 12 is received and the Oldham ring 26 vibrates in the vicinity of the key groove 19*a* of the main bearing member 19, since a gap is secured between a portion of the Oldham ring 26 in the vicinity of the second key portion 26*b* and the left and right grooves 19*f* of the key grooves 19*a* of the main bearing member 19, the Oldham ring 26 does not come into contact with the main bearing member 19, and contact sound is not generated.

As described above, in this embodiment, the grooves 19*f* are laterally symmetrically formed in the Oldham ring sliding surfaces 19*x* in the vicinity of the key grooves 19*a* of the main bearing member 19 with respect to the key grooves 19*a*, and each of the grooves 19*f* has the depth of 0.3 mm. Therefore, the Oldham ring 26 does not come into contact with the main bearing member 19 and contact sound is not generated. Therefore, since a noise of the compressor can be reduced, the compressor can especially suitably be applied as a compressor for an automobile air conditioner.

Sixth Embodiment

Figure 10:
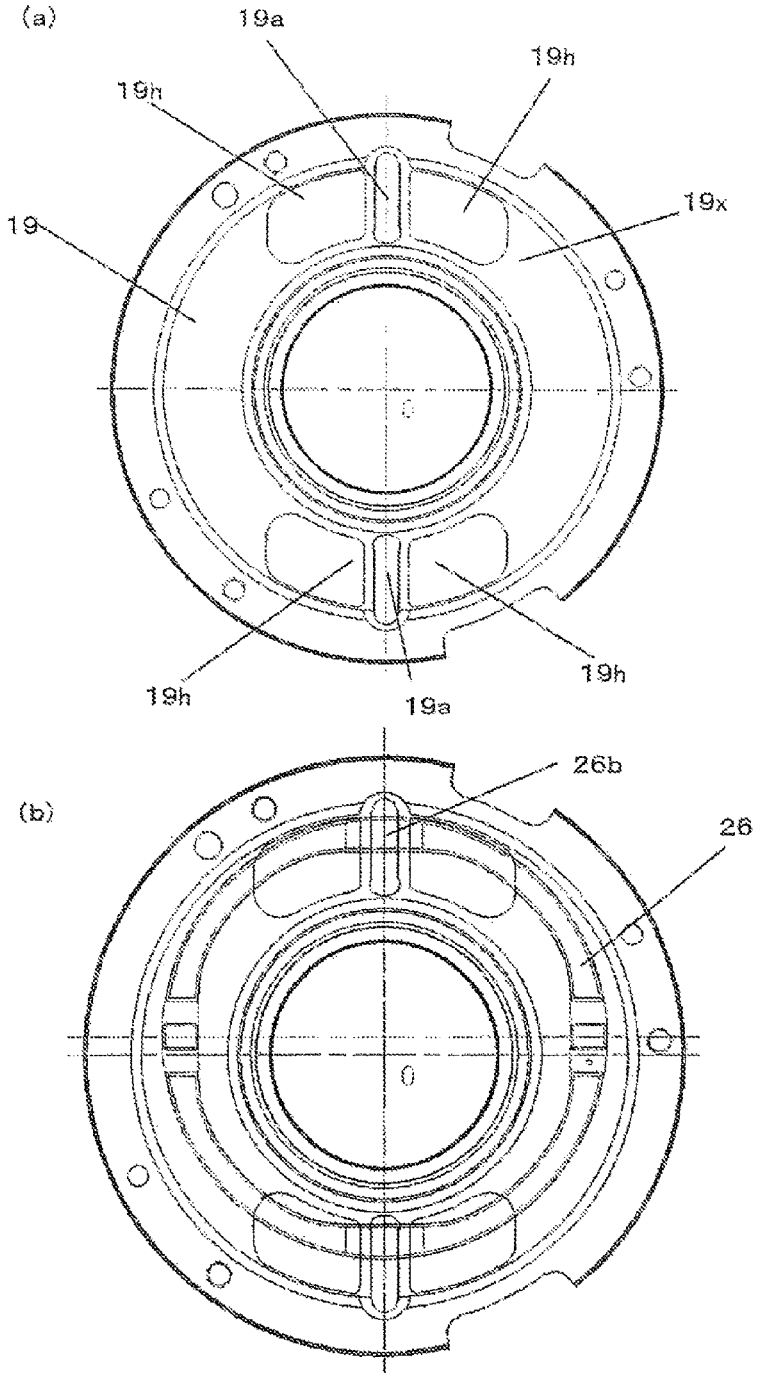
FIG. 10(*a*) is a front view of a main bearing member of a scroll compressor according to a sixth embodiment, and FIG. 10(*b*) is a front view when an Oldham ring is superposed on the main bearing member of the scroll compressor of the sixth embodiment.
Figure 11:
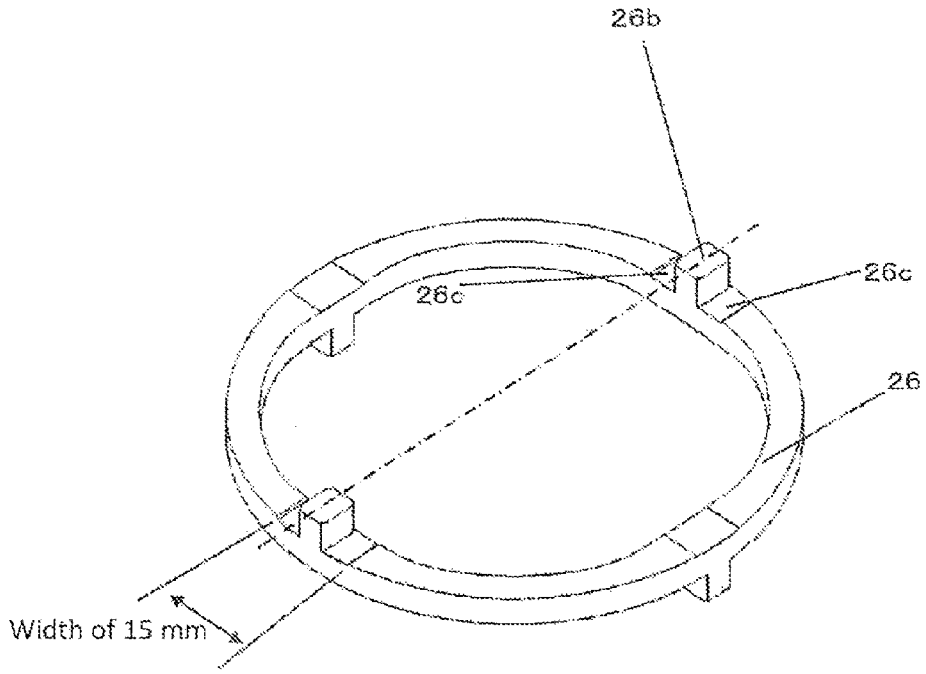
FIG. 11 is a perspective view of the Oldham ring of the scroll compressor of the sixth embodiment.
Figure 12:
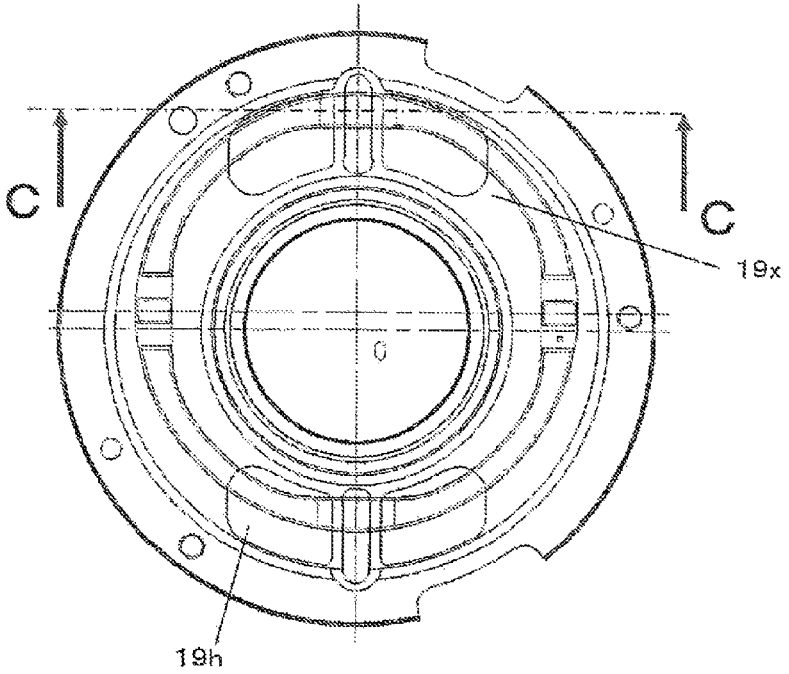
FIG. 12(*a*) is a sectional view when the Oldham ring is superposed on the main bearing member of the scroll compressor of the sixth embodiment, and FIG. 12(*b*) is a sectional view taken along a C-C line in FIG. 12(*a*)
Figure 12:
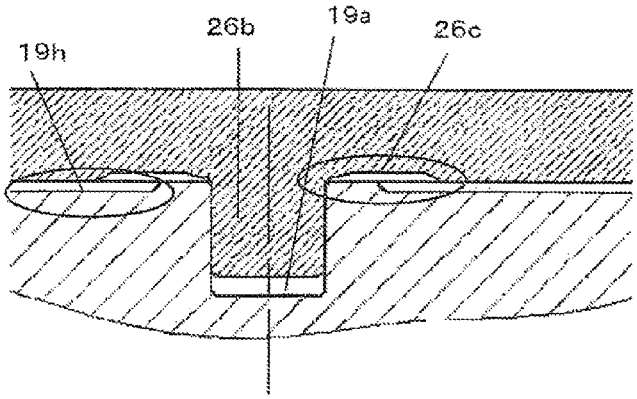

FIG. 10(*a*) is a front view of a main bearing member of a scroll compressor according to a fifth embodiment of the present invention, and FIG. 10(*b*) is a front view when an Oldham ring is superposed on the main bearing member. FIG. 11 is a perspective view of the Oldham ring of the sixth embodiment. FIG. 12(*a*) is a front view when the Oldham ring is superposed on the main bearing member of the sixth embodiment, and FIG. 12(*b*) is a sectional view taken along a C-C line in FIG. 12(*a*).

In FIG. 11, relief grooves 26*c* for machining second key portions 26*b* are laterally symmetrically formed in both sides of the second key portions 26*b* of an Oldham ring 26. Each of the relief grooves 26*c* has a width of 15 mm and a depth of 0.4 mm. In FIG. 10, grooves 19*h* are laterally symmetrically formed in Oldham ring sliding surfaces 19*x* in the vicinity of the of the key grooves 19*a* of the main bearing member 19 with respect to the key grooves 19*a* at positions opposed to the relief grooves 26*c* formed in the Oldham ring 26 shown in FIG. 11. Each of the grooves 19*h* has a width of 50 mm and a depth of 0.4 mm. In this case, the grooves 19*h* formed in the both sides of the key grooves 19*a* are separated from the key grooves 19*a* by a predetermined distance (2 mm). Here, it is preferable that the predetermined distance between the key groove 19*a* and the groove 19*h* is shorter than the width of the relief groove 26*c*.

According to this embodiment, by the relief grooves 26*c* of the Oldham ring 26 and the grooves 19*h* of the main bearing member 19, gaps are always laterally symmetrically formed in sections of a width of 50 mm on both sides of the key groove 19*a* as shown by portions surrounded by rings in FIG. 12(*b*). Hence, even if a reaction force from the orbiting scroll 12 is received and the Oldham ring 26 vibrates in the vicinity of the key groove 19*a* of the main bearing member 19, since a gap is secured between a portion of the Oldham ring 26 in the vicinity of the second key portion 26*b* and the left and right grooves 19*h* of the key grooves 19*a* of the main bearing member 19, the Oldham ring 26 does not come into contact with the main bearing member 19, and contact sound is not generated.

Further, since the grooves 19*h* are formed in the vicinity of the both sides of the key grooves 19*a*, a contact area of the second key portion 26*b* with respect to the key groove 19*a* of the main bearing member can be increased. Therefore, since the contact area of the Oldham ring 26 can be increased, contact surface pressure can be reduced, and wearing of the key portion 26*a* of the Oldham ring 26 and wearing of the key groove 19*a* of the main bearing member can be reduced.

As described above, in this embodiment, the Oldham ring 26 does not come into contact with the main bearing member 19, contact sound is not generated and a noise of the compressor can be reduced of course. In this embodiment, wearing of the key portion 26*a* of the Oldham ring 26 and wearing of the key groove 19*a* of the main bearing member can be reduced, and it is possible to provide a reliably scroll compressor.

Seventh Embodiment

Figure 13:
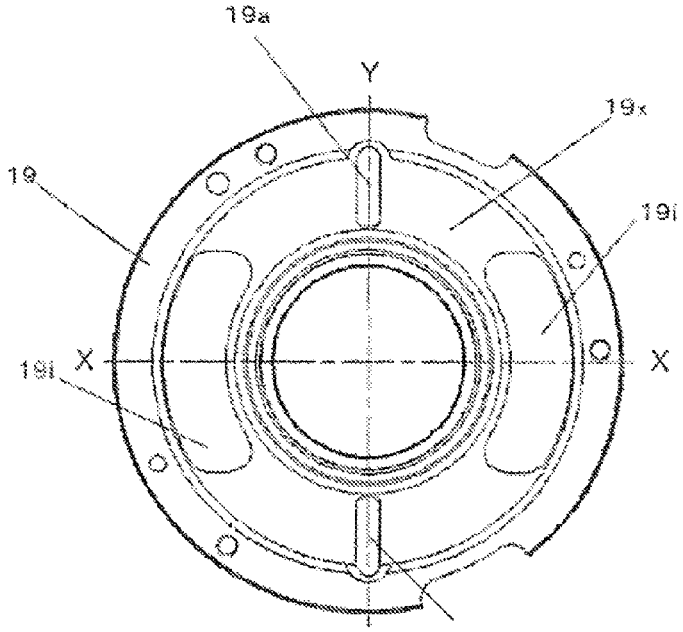
FIG. 13(*a*) is a front view of a main bearing member of a scroll compressor according to a seventh embodiment, and FIG. 13(*b*) is a front view when an Oldham ring is superposed on the main bearing member of the scroll compressor of the seventh embodiment.
Figure 13:
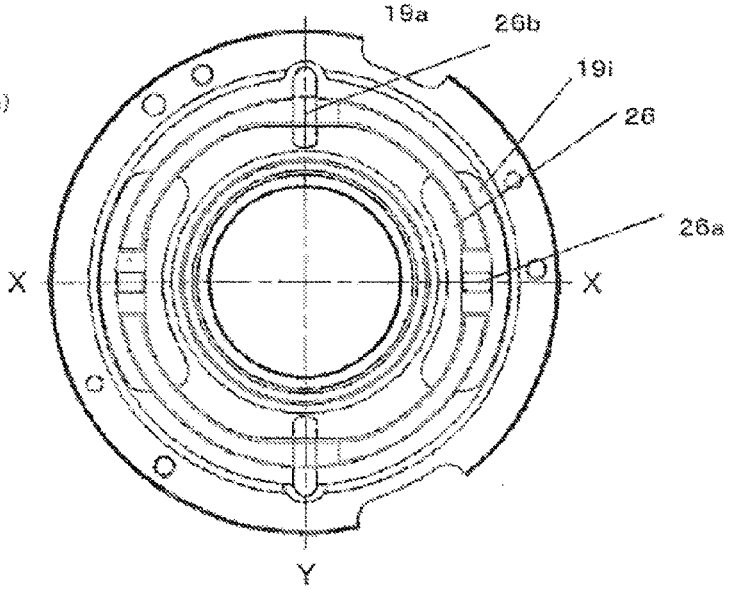

FIG. 13(*a*) is a front view of a main bearing member of a scroll compressor according to a seventh embodiment of the present invention, and FIG. 13(*b*) is a front view when an Oldham ring is superposed on the main bearing member.

The seventh embodiment shows a case where flatness of left and right portions of the second key portion 26*b* of the Oldham ring 26 is enhanced by machining but flatness of a back side of a key portion 26*a* is poor due to a problem of a producing method.

In this case, grooves 19*i* are laterally symmetrically formed, with respect to a phantom line X, in both sides of key grooves 19*a* on the phantom line X which intersects, at right angles, with a phantom line Y which connects the pair of key grooves 19*a* to each other, i.e., at positions corresponding to a back side 26*d* (see FIG. 2) of the key portion 26*a* on the side of the orbiting scroll 12. Each of the grooves 19*i* has a width of 50 mm and a depth of 0.4 mm.

Hence, even if flatness of the back side 26*d* of the key portion 26*a* on the side of the orbiting scroll of the Oldham ring 26 is poor and the back side 26*d* is prone to come into contact with the main bearing member 19 at its portion intersecting with the key groove 19*a*, since the groove 19*i* is formed in the intersection of the main bearing member 19, the back side 26*d* does not easily come into contact with the Oldham ring 26, and contact sound is not generated.

As described above, in this embodiment, when the flatness of the back side 26*d* of the key portion 26*a* of the Oldham ring 26 is poor, the grooves 19*i* are formed on the phantom line X which intersect, at right angles, with the phantom line Y which connects the key grooves 19*a* to each other. Therefore, it is possible to restrain the Oldham ring 26 from coming into contact with the main bearing member 19, and to prevent contact sound from generating. Therefore, since a noise of the compressor can be reduced, the compressor can especially suitably be applied as a compressor for an automobile air conditioner.

INDUSTRIAL APPLICABILITY

As described above, according to the scroll compressor of the present invention, it is possible to restrain the Oldham ring from coming into contact with the main bearing member in the vicinity of the of the key groove of the main bearing member, and to restrain the Oldham ring from vibrating. Therefore, it is possible to provide an inexpensive scroll compressor of low noise. Working fluid is not limited to a refrigerant. Hence, the scroll compressor of the present invention can widely be used for an air scroll compressor, a vacuum pump and a scroll fluid machine such as a scroll-type expansion machine.

The invention claimed is:

1. A scroll compressor in which an orbiting scroll is provided between a main bearing member and a fixed scroll, wherein the fixed scroll and the orbiting scroll are meshed with each other such that spiral laps of the fixed scroll and the orbiting scroll inwardly face each other, an Oldham ring is provided between the main bearing member and the orbiting scroll, a key portion of the Oldham ring is inserted into a key groove of the main bearing member, relief grooves are formed on both sides of the key portion of the Oldham ring, bearing grooves are formed in Oldham ring sliding surfaces on both sides of the key groove, the bearing grooves are separated from the key groove, and the relief grooves and the bearing grooves overlap each other.

2. The scroll compressor according to claim 1, wherein a portion of each of the bearing grooves in a sliding direction of the Oldham ring has a slope shape.

3. The scroll compressor according to claim 1, wherein the bearing grooves are laterally symmetrically formed on both sides of the key groove so as to extend circumferentially in ranges of 45° or less with respect to a center of the key groove.

4. The scroll compressor according to claim 1, wherein each of the relief grooves is formed immediately adjacent to the side of the key portion of the Oldham ring.

* * * * *